US008761418B2

(12) United States Patent
Feyh et al.

(10) Patent No.: US 8,761,418 B2
(45) Date of Patent: Jun. 24, 2014

(54) MICROELECTROMECHANICAL LOUDSPEAKER ARRAY WITH PREDETERMINED PERIOD OF TIME OF DIAPHRAGM RELAXATION

(71) Applicant: Robert Bosch GmbH, Stuttgart (DE)

(72) Inventors: Ando Feyh, Palo Alto, CA (US); Stefan Zimmermann, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 13/650,524

(22) Filed: Oct. 12, 2012

(65) Prior Publication Data

US 2013/0094679 A1 Apr. 18, 2013

(30) Foreign Application Priority Data

Oct. 14, 2011 (DE) ..... 10 2011 084 541

(51) Int. Cl.
*H04R 9/06* (2006.01)

(52) U.S. Cl.
USPC ..... 381/186; 381/182

(58) Field of Classification Search
USPC ..... 381/182, 186
See application file for complete search history.

(56) References Cited

U.S. PATENT DOCUMENTS

| | | | | |
|---|---|---|---|---|
| RE42,347 | E * | 5/2011 | Rombach et al. | 381/174 |
| 2001/0003166 | A1* | 6/2001 | Gulick | 700/94 |
| 2010/0104115 | A1 | 4/2010 | Zheng et al. | |
| 2011/0103620 | A1* | 5/2011 | Strauss et al. | 381/150 |
| 2012/0300949 | A1* | 11/2012 | Rauhala et al. | 381/55 |

* cited by examiner

*Primary Examiner* — Brian Ensey
*Assistant Examiner* — Katherine Faley
(74) *Attorney, Agent, or Firm* — Maginot, Moore & Beck

(57) ABSTRACT

A microelectromechanical loudspeaker array includes a plurality of microelectromechanical loudspeaker elements each having a diaphragm element configured to be deflected from a neutral position into at least one deflection position to produce a sound pulse. The array further includes an actuation device which is configured to put the diaphragm element into the at least one deflection position from the neutral position on the basis of drive signals. The array further includes a control device coupled to the plurality of loudspeaker elements. The control device is configured to send, in each case at a driving time, (i) a first drive signal configured to produce a sound pulse by actuating the diaphragm element, and (ii) a respective second drive signal configured to relax the diaphragm element into the neutral position during a predetermined period of time after the driving time to the actuation device of at least one of the loudspeaker elements.

15 Claims, 3 Drawing Sheets

MICROELECTROMECHANICAL LOUDSPEAKER ARRAY WITH PREDETERMINED PERIOD OF TIME OF DIAPHRAGM RELAXATION

This application claims priority under 35 U.S.C. §119 to patent application no. DE 10 2011 084 541.0, filed on Oct. 14, 2011 in Germany, the disclosure of which is incorporated herein by reference in its entirety.

BACKGROUND

The disclosure relates to a microelectromechanical loudspeaker array and to a method for operating a microelectromechanical loudspeaker array.

Microelectromechanical loudspeakers (MEMS loudspeakers) operate on the basis of individual loudspeaker elements which can be combined to form two-dimensional arrays of loudspeaker elements. In this case, a respective loudspeaker element corresponds to one pixel of the array, with each pixel being able to be driven separately.

By way of example, the document US 2010/0104115 A1 discloses an array comprising microelectromechanical, magnetically driven loudspeaker chips which can be used to produce sound waves by actuating microelectromechanical diaphragms.

SUMMARY

According to one aspect, the present disclosure provides a microelectromechanical loudspeaker array, having a multiplicity of microelectromechanical loudspeaker elements which each have: a diaphragm element, which can be deflected from a neutral position into at least one deflection position in order to produce a sound pulse, and an actuation device, which is designed to put the diaphragm element into the at least one deflection position from the neutral position on the basis of drive signals. The microelectromechanical loudspeaker array furthermore comprises a control device which is coupled to the multiplicity of microelectromechanical loudspeaker elements and which is designed to send, in each case at a driving time, a first drive signal for producing a sound pulse by actuating the diaphragm element, and a respective second drive signal for relaxing the diaphragm element into the neutral position during a predetermined period of time after the driving time, to the actuation device of at least one of the microelectromechanical loudspeaker elements.

According to a further aspect, the present disclosure provides a method for operating a microelectromechanical loudspeaker array which has a multiplicity of microelectromechanical loudspeaker elements having a respective diaphragm element, which can be deflected from a neutral position into at least one deflection position in order to produce a sound pulse, and a respective actuation device, which is designed to put the diaphragm element into the at least one deflection position from the neutral position on the basis of drive signals. The method comprises the steps of the multiplicity of microelectromechanical loudspeaker elements being driven to produce a sound signal by superposing a multiplicity of sound pulses, at least one from the multiplicity of microelectromechanical loudspeaker elements being driven to produce a first sound pulse by deflecting the respective diaphragm element from the neutral position into the deflection position at a first driving time, the at least one microelectromechanical loudspeaker element being driven to relax the diaphragm element from the deflection position into the neutral position during a predetermined period of time after the first driving time, and the at least one microelectromechanical loudspeaker element being driven again to produce a second sound pulse by deflecting the respective diaphragm element from the neutral position into the deflection position at a second driving time, wherein the first driving time and the second driving time are within the duration of a half-cycle of the sound signal.

One concept of the present disclosure is to make multiple uses of individual microelectromechanical loudspeaker elements in a microelectromechanical loudspeaker array within a half-cycle of a sound wave that is to be generated. In this case, following initial deflection of the diaphragm of a loudspeaker element at a first time within the half-cycle, the diaphragm can be slowly relaxed into an initial position. Following relaxation, the loudspeaker element is again available for deflection in the same direction. If the relaxation takes place in a period which is shorter than the duration of the half-cycle, the loudspeaker element can contribute to producing a sound wave within the same half-cycle.

One advantage of the disclosure is that the efficiency of the microelectromechanical loudspeaker array is increased, since fewer separate loudspeaker elements or pixels are required for producing a half-cycle.

A further advantage of the disclosure is that it significantly improves the audio quality of the audio signals produced by the microelectromechanical loudspeaker array for a constant array surface area or a constant number of pixels. Particularly at low frequencies below approximately 500 Hz, the desired frequency spectrum can be achieved in a very much better manner with the loudspeaker array according to the disclosure. Conversely, the number of pixels in the microelectromechanical loudspeaker array can be reduced with a constant audio quality, which first of all allows a reduced chip surface area and hence better miniaturization of the loudspeaker array, for example for mobile applications, and secondly lowers production costs as a result of the reduced number of loudspeaker elements.

According to one embodiment, the actuation devices may be designed to deflect the respective diaphragm element electrostatically, electromagnetically, piezoelectrically or electromechanically.

According to a further embodiment, the control device may be designed to drive the microelectromechanical loudspeaker elements to produce a sound signal by superposing sound pulses from individual microelectromechanical loudspeaker elements. According to one preferred embodiment, the predetermined period of time may be shorter than the duration of a half-cycle of the sound signal. As a result, it is possible to use a microelectromechanical loudspeaker element at least twice over the duration of a half-cycle of the sound signal in order to produce a sound pulse.

According to a further embodiment, the control device may be designed to send a first drive signal to at least one from the multiplicity of microelectromechanical loudspeaker elements at least twice over the duration of a half-cycle of the sound signal.

According to a further embodiment, the diaphragm element of at least one from the multiplicity of microelectromechanical loudspeaker elements may have at least one passage hole. This facilitates the relaxation of the diaphragm element into the neutral position without undesirable sound pulse production being able to arise.

According to one embodiment of the method, the respective diaphragm element can be deflected electrostatically, electromagnetically, piezoelectrically or electromechanically.

According to a further embodiment of the method, the frequency of the sound signal may be less than 500 Hz. This is particularly advantageous, since at low frequencies of the sound signal the duration of the half-cycles is longer, and hence more loudspeaker elements can contribute two or more times to producing the sound signal during a half-cycle.

BRIEF DESCRIPTION OF THE DRAWINGS

Further features and advantages of embodiments of the disclosure can be found in the description below with reference to the appended drawings.

In the drawings.

Figure 1:
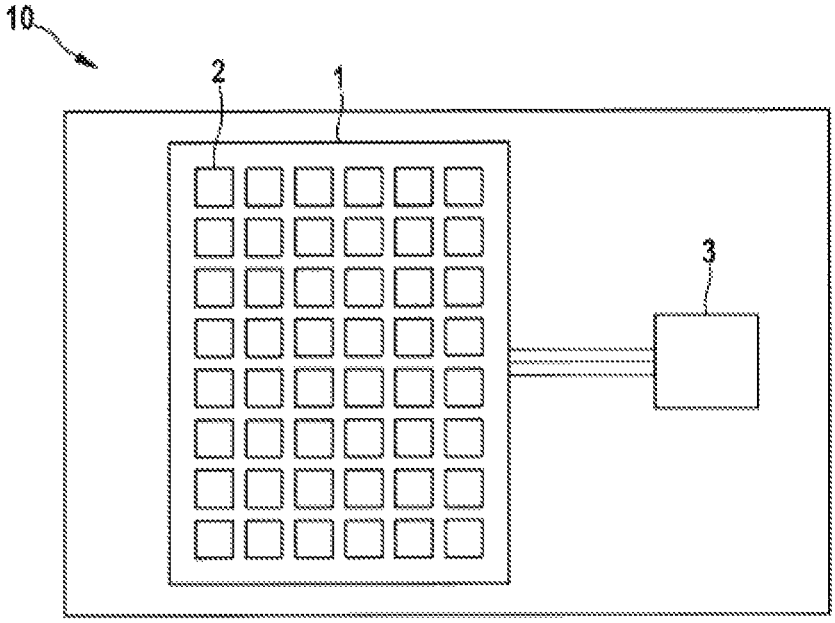
FIG. 1 shows a schematic illustration of a system with a microelectromechanical loudspeaker array according to an embodiment of the disclosure.

Where useful, the refinements and developments described can be combined with one another arbitrarily. Further possible refinements, developments and implementations of the disclosure also comprise combinations of features of the disclosure described for the exemplary embodiments previously or subsequently which are not explicitly cited.

The accompanying drawings are intended to convey further comprehension of the embodiments of the disclosure. They illustrate embodiments and serve to explain principles and concepts of the disclosure in conjunction with the description. Other embodiments and many of the cited advantages arise in light of the drawings. The elements in the drawings are not necessarily shown to scale in relation to one another. Identical reference symbols in the drawings denote components which are the same or which have a similar action.

DETAILED DESCRIPTION

Loudspeaker arrays within the meaning of the present disclosure include all two-dimensional combinations of identical or similar microelectromechanical individual loudspeakers which can be driven independently of one another to produce audio signals. In this case, the individual loudspeakers may include any kind of microelectromechanical loudspeakers, subsequently MEMS loudspeakers for short. By way of example, the MEMS loudspeakers can be driven electrostatically, piezoelectrically, electromagnetically, electromechanically or in a similar way. The number of MEMS loudspeakers in an array is not limited, in principle, in this context and can be adapted by the demands on audio quality, array size, the frequency range to be covered, production costs, technical field of use or other external constraints.

FIG. 1 shows a schematic illustration of a system 10 with a microelectromechanical loudspeaker array 1, subsequently MEMS loudspeaker array for short. MEMS loudspeaker array 1 comprises a multiplicity of MEMS loudspeakers or MEMS loudspeaker elements 2 which serve as pixels in the MEMS loudspeaker array 1. Each of the pixels can be driven to produce audio signals independently of the other pixels by means of a control device 3 for the MEMS loudspeaker array 1. By way of example, the system 10 may be arranged in a mobile telephone, a smartphone, a computer, a microelectromechanical hearing aid or similar application appliances.

Figure 2:
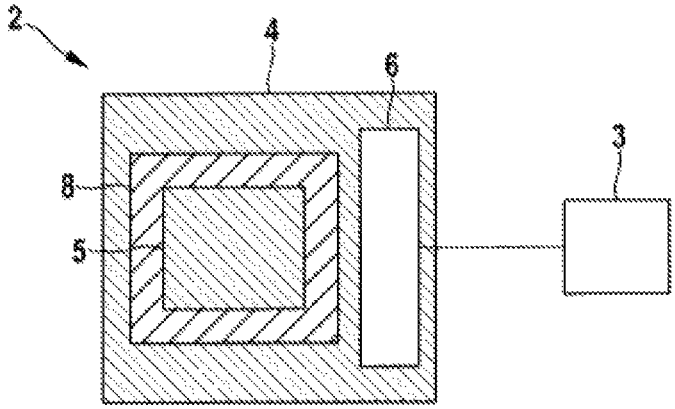
FIG. 2 shows a schematic illustration of a loudspeaker element from a microelectromechanical loudspeaker array according to a further embodiment of the disclosure.

FIG. 2 shows a schematic illustration of an MEMS loudspeaker element 2 in an MEMS loudspeaker array 1. By way of example, the MEMS loudspeaker element 2 may be constructed on a carrier substrate 4. Audio signals can be produced by using a diaphragm element 8, for example, which is kept at a distance from the carrier substrate 4 by a spacer 5. This allows the diaphragm element 8 to be deflected, and hence to produce a sound wave. The diaphragm element 8 can be deflected quite generally by an actuation device 6, which can use suitable actuation elements to prompt actuation of the diaphragm element 8. In this case, the actuation device 6 can be supplied with appropriate drive signals by the control device 3, so that the sound wave production by the diaphragm element 8 and hence by the individual MEMS loudspeaker element 2 can be coordinated in cooperation with other MEMS loudspeaker elements in the MEMS loudspeaker array 1.

In this case, the MEMS loudspeaker element 2 can adopt three defined states which are provided by the deflection of the diaphragm element 8. In an undeflected position, what is known as a neutral position, the diaphragm element 8 is not being driven. The other two states can be achieved by deflecting the diaphragm element 8 either toward the carrier substrate 4 (negative deflection) or away from the carrier substrate 4 (positive deflection). It is possible, in this case, to change over between the states by virtue of actuation by means of a delta pulse. In this case, the diaphragm element 8 can be taken from the neutral position into the position of positive deflection, for example. The diaphragm element 8 moves very quickly in this case, so that pressure is exerted on the surrounding atmosphere, and this produces a sound pressure signal.

Figure 3:
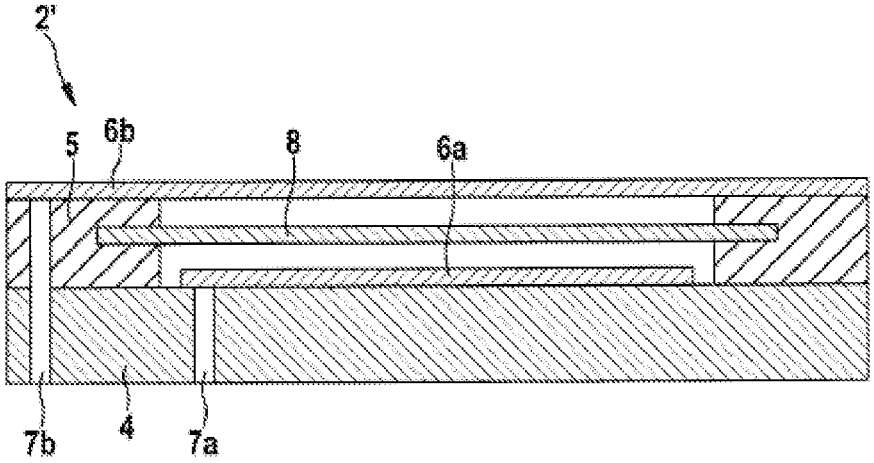
FIG. 3 shows a schematic illustration of an exemplary embodiment of a loudspeaker element from a microelectromechanical loudspeaker array according to a further embodiment of the disclosure.
Figure 4:
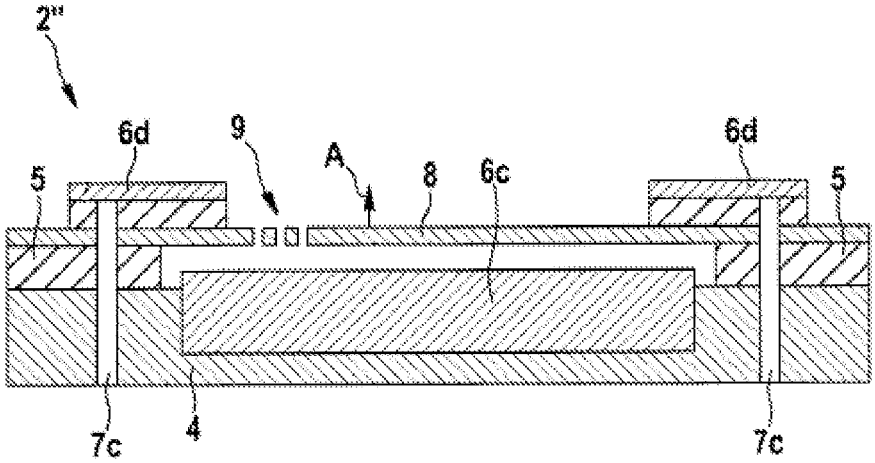
FIG. 4 shows a schematic illustration of an exemplary embodiment of a loudspeaker element from a microelectromechanical loudspeaker array according to a further embodiment of the disclosure.

Two exemplary embodiments of an MEMS loudspeaker element 2 are shown schematically in FIGS. 3 and 4 in this context. The MEMS loudspeaker element 2' in FIG. 3 has two electrodes **6*a* and 6*b*, which can each have charge applied to them via supply lines 7*a* and 7*b*. The electrostatic attraction between the respective electrodes 6*a* and 6*b* and the diaphragm element 8 can be used to achieve deflection of the diaphragm element 8. The MEMS loudspeaker element 2" in FIG. 4 has a permanent magnet 6*c* and also a line winding 6*d*. The line winding 6*d* can have a current with an annular profile applied to it via supply lines 7*c*. The interaction between the permanent magnetic field from the permanent magnet 6*c* and the current flowing through the in the line winding 6*d* produces an electromagnetic attraction or repulsion which can deflect the diaphragm element 8 toward the carrier substrate 4 or away from the carrier substrate 4. By way of example, FIG. 4 shows a deflection A from the carrier substrate 4**.

In addition, FIG. 4 shows one or more passage holes 9 through the diaphragm element 8. In this case, the passage hole(s) 9 may have a very small diameter, so that when the diaphragm element 8 is moving relatively quickly the passage holes 9 form a high fluidic resistance toward the gas that is trapped between the carrier substrate 4 and the diaphragm element 8. When the diaphragm element 8 is moving relatively slowly, however, pressure equalization can take place between the trapped gas and the surroundings, since gas molecules can flow through the passage holes in sufficient quantity or at sufficient speed to allow equalization of the pressure buildup as a result of the movement of the diaphragm element 8. When the diaphragm element 8 is moving slowly, this allows a movement without significant sound pressure contribution to be achieved.

Figure 5:
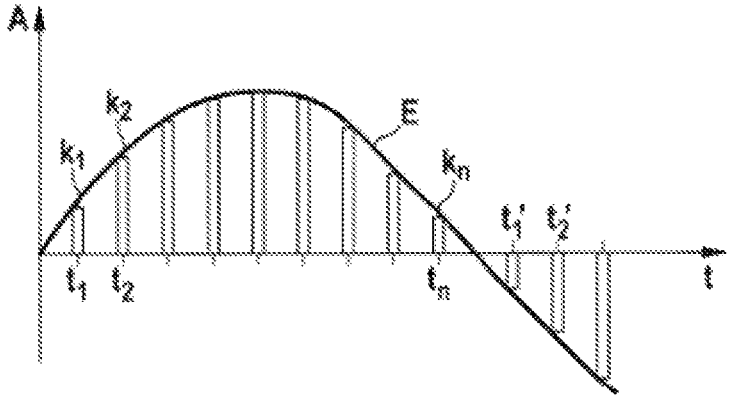
FIG. 5 shows a schematic illustration of an amplitude/time graph, illustrating the sound wave production using a microelectromechanical loudspeaker array, according to a further embodiment of the disclosure.

FIG. 5 shows a schematic illustration of an amplitude/time graph which illustrates the sound wave production using a microelectromechanical loudspeaker array 1. A sound signal E at a predetermined frequency and amplitude can be produced by using individual sound pulses from pixels or MEMS loudspeaker elements 2. In this case, the individual sound pulses can represent the envelope of the sound signal E by means of superposition. What is shown is a positive half-cycle of the sound signal E, which is produced from individual sound pulses, said half-cycle being formed at a sampling frequency by means of suitable driving of individual MEMS loudspeaker elements 2.

At a first time $t_1$, a number $k_1$ of MEMS loudspeaker elements 2 are put into a deflection position. At a second time $t_2$, which follows the first time $t_1$, a number $k_2$ of MEMS loudspeaker elements 2 are put into the deflection position. Since the instantaneous amplitude that is to be produced for the sound signal E is greater at the time $t_2$ than at the time $t_1$, the number $k_2$ is greater than the number $k_1$. In addition, the quantity of MEMS loudspeaker elements 2 that are actuated at the time $t_1$ is disjunct from the quantity of MEMS loudspeaker elements 2 that are actuated at the time $t_2$, since the MEMS loudspeaker elements 2 that are actuated at the time $t_1$ are already in the deflected position at the time $t_2$ and are no longer available again for deflection. Accordingly, a sound signal E at a low frequency, for which the duration of a half-cycle is relatively long, requires a large number of MEMS loudspeaker elements 2 in order to produce the half-cycle by means of superposition at the same sampling frequency.

In principle, the number n of sampling points during a half-cycle is unlimited, in the same way as the respective number $k_n$ of MEMS loudspeaker elements 2 that are to be actuated is not stipulated. At times $t_1'$, $t_2'$, etc., the negative half-cycle of the sound signal E can be produced by actuating the MEMS loudspeaker elements 2 that are used for producing the positive half-cycle, since a deflection from the positive deflection position into the negative deflection position is now possible again.

Figure 6:
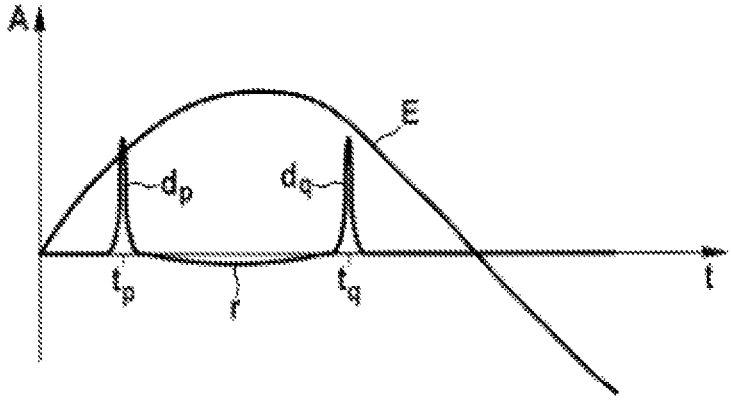
FIG. 6 shows a schematic illustration of an amplitude/time graph, illustrating the sound wave production using a microelectromechanical loudspeaker array, according to a further embodiment of the disclosure.

FIG. 6 shows a schematic illustration of an amplitude/time graph which illustrates the sound wave production using a microelectromechanical loudspeaker array 1. A pixel or any MEMS loudspeaker element is actuated at the time $t_p$ by a delta pulse $d_p$. This puts the pixel or the MEMS loudspeaker element into a positive deflection position from a neutral position (or a negative deflection position) and means that it contributes to superposing the sound signal E at the time $t_p$ to form a sound pulse. The MEMS loudspeaker element can then be slowly relaxed r back into the neutral position. The slow relaxation, which takes a certain period between the time $t_p$ and the time $t_q$, reduces the sound pulse amplitude to an extent such that the MEMS loudspeaker element makes no or at least no significant contribution to the overall sound signal E as a result of the relaxation. Ideally, the movement for the relaxation r takes place so slowly that the equalization takes place downward completely without output sound.

This can be assisted by one or more passage holes 9 in the diaphragm element 8 of the MEMS loudspeaker element, as shown by way of example in FIG. 4. The slow relaxation means that gas molecules between diaphragm element 8 and carrier substrate 4 can flow efficiently through the passage holes and thereby bring about pressure equalization without the output of sound pressure. When the diaphragm element 8 is moving quickly, initiated by the delta pulse $d_p$, at the time $t_p$, however, the passage holes 9 are almost inactive on account of effects attributable to fluid dynamics, that is to say a high level of friction attributable to fluid dynamics.

Following the relaxation time, the MEMS loudspeaker element is again in the neutral position (or alternatively the negative deflection position) at the time $t_q$. If the half-cycle of the sound signal E is not yet complete at this time $t_q$, the same MEMS loudspeaker element can once again be used to produce the sound signal E at the time $t_q$. The frequency of the sound signal E that is to be generated is therefore responsible for the available relaxation time. At low frequencies, more relaxation time is therefore available before a half-cycle is complete. Particularly at low frequencies, it is thus possible to use more MEMS loudspeaker elements twice or even repeatedly to produce the half-cycle.

In this context, the actuation of the MEMS loudspeaker element can be coordinated via the control device 3, which is respectively coupled to each of the multiplicity of MEMS loudspeaker elements. To this end, the control device 3 can send a first drive signal to the actuation device of the respective MEMS loudspeaker element at the time $t_q$. As a result, the actuation device produces the delta pulse $d_p$ for producing a sound pulse. The control device 3 may also send a second drive signal to the actuation device, which second drive signal brings about the slow relaxation r of the diaphragm element 8 into the neutral position. This can take place during the predetermined period of time between the times $t_p$ and $t_q$, as a result of which the MEMS loudspeaker element can be driven at the time $t_q$ again by means of a first drive signal to the actuation device and can again produce a sound pulse.

Figure 7:
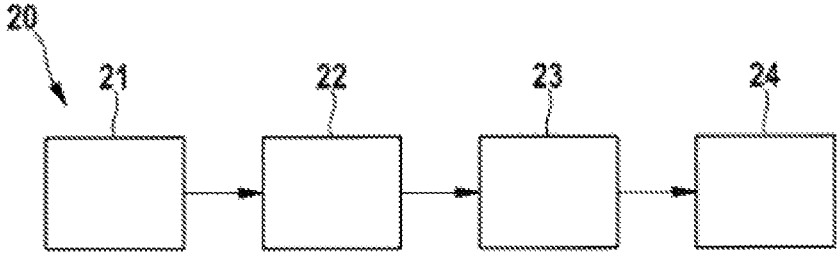
FIG. 7 shows a schematic illustration of a method for operating a microelectromechanical loudspeaker array according to a further embodiment of the disclosure.

FIG. 7 shows a schematic illustration of a method 20 for operating a microelectromechanical loudspeaker array, particularly an MEMS loudspeaker array 1 as described in conjunction with FIGS. 1 to 6. The method 20 comprises the step 21 of a multiplicity of microelectromechanical loudspeaker elements 2 in the microelectromechanical loudspeaker array 1 being driven to produce a sound signal E by superposing a multiplicity of sound pulses. In this case, the control device 3 can coordinate the driving of the multiplicity of microelectromechanical loudspeaker elements 2 in order to achieve suitable superposition of sound pulses by virtue of the interaction of the loudspeaker elements 2, as explained in conjunction with FIG. 5.

In this case, the method 20 comprises the step 22 of at least one from the multiplicity of microelectromechanical loudspeaker elements 2 being driven to produce a first sound pulse by virtue of the respective diaphragm element 8 being deflected from the neutral position into the deflection position at a first driving time $t_p$. In a subsequent step 23 may comprise the relevant microelectromechanical loudspeaker element 2 being driven to relax the diaphragm element 8 from the deflection position into the neutral position during a predetermined period of time after the first driving time $t_p$. When the diaphragm element 8 has relaxed completely into the neutral position again, a step 24 can involve said microelectromechanical loudspeaker element 2 being driven again, so that a second sound pulse is produced at a second driving time $t_q$.

In this case, the first and second driving times $t_p$ and $t_q$ are so close to one another in time that the loudspeaker element 2 can contribute to producing the sound signal E at least twice over the duration of a half-cycle of the sound signal E. In this way, it is possible to reduce the overall number of loudspeaker elements 2 which are required for producing particularly a low-frequency sound signal, for example at a frequency of below 500 Hz. Alternatively, a constant number of loudspeaker elements 2 can be used to increase the sampling frequency of the loudspeaker array 1 and hence to improve the audio quality of the sound signal.

What is claimed is:

1. A microelectromechanical loudspeaker array, comprising: a plurality of microelectromechanical loudspeaker elements each having: a diaphragm element configured to be deflected from a neutral position into at least one deflection position to produce a sound pulse; and an actuation device configured to put the diaphragm element into the at least one deflection position from the neutral position on the basis of drive signals; and a control device coupled to the plurality of microelectromechanical loudspeaker elements, the control device being configured to send (i) a first drive signal configured to produce the sound pulse by actuating the diaphragm element at a respective driving time, wherein one or more sound pulses represent a sound signal, and (ii) a respective second drive signal configured to relax the diaphragm element into the neutral position during a predetermined period of time after the driving time to the actuation device of at least one of the microelectromechanical loudspeaker elements, wherein the predetermined period of time is shorter than the duration of a half-cycle of the sound signal.

2. The microelectromechanical loudspeaker array according to claim 1, wherein the actuation devices are configured to deflect the respective diaphragm element electrostatically, electromagnetically, piezoelectrically or electromechanically.

3. The microelectromechanical loudspeaker array according to claim 1, wherein the diaphragm element of at least one of the plurality of microelectromechanical loudspeaker elements defines at least one passage hole.

4. A microelectromechanical loudspeaker array comprising: a plurality of microelectromechanical loudspeaker elements each having: a diaphragm element configured to be deflected from a neutral position into at least one deflection position to produce a sound pulse; and an actuation device configured to put the diaphragm element into the at least one deflection position from the neutral position on the basis of drive signals; and a control device coupled to the plurality of microelectromechanical loudspeaker elements, the control device being configured to send (i) a first drive signal configured to produce the sound pulse by actuating the diaphragm element at a respective driving time and (ii) a respective second drive signal configured to relax the diaphragm element into the neutral position during a predetermined period of time after the driving time to the actuation device of at least one of the microelectromechanical loudspeaker elements wherein the control device is configured to drive the microelectromechanical loudspeaker elements to produce a sound signal by superposing each sound pulse from each microelectromechanical loudspeaker elements and wherein the predetermined period of time is shorter than the duration of a half-cycle of the sound signal.

5. The microelectromechanical loudspeaker array according to claim 4, wherein the actuation devices are configured to deflect the respective diaphragm element electrostatically, electromagnetically, piezoelectrically or electromechanically.

6. The microelectromechanical loudspeaker array according to claim 4, wherein the diaphragm element of at least one of the plurality of microelectromechanical loudspeaker elements defines at least one passage hole.

7. The microelectromechanical loudspeaker array according to claim 6, wherein the actuation devices are configured to deflect the respective diaphragm element electrostatically, electromagnetically, piezoelectrically or electromechanically.

8. The microelectromechanical loudspeaker array comprising: a plurality of microelectromechanical loudspeaker elements each having: a diaphragm element configured to be deflected from a neutral position into at least one deflection position to produce a sound pulse; and an actuation device configured to put the diaphragm element into the at least one deflection position from the neutral position on the basis of drive signals; and a control device coupled to the plurality of microelectromechanical loudspeaker elements, the control device being configured to send (i) a first drive signal configured to produce the sound pulse by actuating the diaphragm element at a respective driving time and (ii) a respective second drive signal configured to relax the diaphragm element into the neutral position during a predetermined period of time after the driving time to the actuation device of at least one of the microelectromechanical loudspeaker elements wherein the control device is configured to drive the microelectromechanical loudspeaker elements to produce a sound signal by superposing each sound pulse from each microelectromechanical loudspeaker element and wherein the control device is configured to send the first drive signal to at least one of the plurality of microelectromechanical loudspeaker elements at least twice over the duration of a half-cycle of the sound signal.

9. The microelectromechanical loudspeaker array according to claim 8, wherein the actuation devices are configured to deflect the respective diaphragm element electrostatically, electromagnetically, piezoelectrically or electromechanically.

10. The microelectromechanical loudspeaker array according to claim 8, wherein the diaphragm element of at least one of the plurality of microelectromechanical loudspeaker elements defines at least one passage hole.

11. The microelectromechanical loudspeaker array according to claim 10, wherein the actuation devices are configured to deflect the respective diaphragm element electrostatically, electromagnetically, piezoelectrically or electromechanically.

12. A method for operating a microelectromechanical loudspeaker array having a plurality of microelectromechanical loudspeaker elements, the loudspeaker elements each having a respective diaphragm element configured to be deflected from a neutral position into at least one deflection position to produce a sound pulse and a respective actuation device configured to return the diaphragm element to the at least one deflection position from the neutral position on the basis of drive signals, the method comprising: driving the plurality of microelectromechanical loudspeaker elements to produce a sound signal by superposing a plurality of the sound pulses; driving at least one of the plurality of microelectromechanical loudspeaker elements to produce a first sound pulse by deflecting the respective diaphragm element from the neutral position into the deflection position at a first driving time; driving the at least one microelectromechanical loudspeaker element to relax the diaphragm element from the deflection position into the neutral position during a predetermined period of time after the first driving time; and driving the at least one microelectromechanical loudspeaker element again to produce a second sound pulse by deflecting the respective diaphragm element from the neutral position into the deflection position at a second driving time.

13. The method according to claim 12, wherein the respective diaphragm element is deflected electrostatically, electromagnetically, piezoelectrically or electromechanically.

14. The method according to claim 12, wherein a frequency of the sound signal is less than 500 Hz.

15. A method for operating a microelectromechanical loudspeaker array having a plurality of microelectromechanical loudspeaker elements, the loudspeaker elements each having a respective diaphragm element configured to be deflected from a neutral position into at least one deflection position to produce a sound pulse and a respective actuation device configured to return the diaphragm element to the at least one deflection position from the neutral position on the basis of drive signals, the method comprising:

driving the plurality of microelectromechanical loudspeaker elements to produce a sound signal;

driving at least one of the plurality of microelectromechanical loudspeaker elements to produce a first sound pulse by deflecting the respective diaphragm element from the neutral position into the deflection position at a first driving time;

driving the at least one microelectromechanical loudspeaker element to relax the diaphragm element from the deflection position into the neutral position during a predetermined period of time after the first driving time;

driving the at least one microelectromechanical loudspeaker element again to produce a second sound pulse by deflecting the respective diaphragm element from the neutral position into the deflection position at a second driving time, and wherein the first driving time and the second driving time are within the duration of a half-cycle of the sound signal.

* * * * *

UNITED STATES PATENT AND TRADEMARK OFFICE

CERTIFICATE OF CORRECTION

PATENT NO. : 8,761,418 B2
APPLICATION NO. : 13/650524
DATED : June 24, 2014
INVENTOR(S) : Ando Feyh et al.

It is certified that error appears in the above-identified patent and that said Letters Patent is hereby corrected as shown below:

In the Claims

Column 8, line 13:
Please delete the text "8. The microelectromechanical loudspeaker" and insert
--8. A microelectromechanical loudspeaker--

Signed and Sealed this
Seventeenth Day of February, 2015

Michelle K. Lee

Michelle K. Lee
*Deputy Director of the United States Patent and Trademark Office*